US006893287B2

(12) United States Patent
Kuo et al.

(10) Patent No.: US 6,893,287 B2
(45) Date of Patent: May 17, 2005

(54) ELECTRICAL CONNECTOR ASSEMBLY

(75) Inventors: Chin Pao Kuo, Tu-Chen (TW); Yun Long Ke, Tu-Chen (TW); Shih Tung Chang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 121 days.

(21) Appl. No.: 10/626,255

(22) Filed: Jul. 23, 2003

(65) Prior Publication Data

US 2004/0248458 A1 Dec. 9, 2004

(30) Foreign Application Priority Data

Jun. 6, 2003 (TW) ..... 92115453 A

(51) Int. Cl.[7] ..... H01R 13/00
(52) U.S. Cl. ..... 439/484
(58) Field of Search ..... 439/484, 177, 439/476.1, 518, 31, 446, 11, 13, 483

(56) References Cited

U.S. PATENT DOCUMENTS 5,380,219 A * 1/1995 Klier ..... 439/446
5,499,932 A * 3/1996 Tanaka et al. ..... 439/446
5,681,171 A * 10/1997 Park ..... 439/31
5,735,707 A * 4/1998 O'Groske et al. ..... 439/446
5,772,447 A * 6/1998 Cheung ..... 439/31
6,027,352 A * 2/2000 Byrne ..... 439/215
6,213,782 B1 * 4/2001 Derstine ..... 439/31
6,220,889 B1 * 4/2001 Ely et al. ..... 439/446
6,273,753 B1 8/2001 Ko
6,305,978 B1 10/2001 Ko
6,319,049 B1 * 11/2001 Lee ..... 439/484
6,398,597 B1 6/2002 Ko
6,406,314 B1 * 6/2002 Byrne ..... 439/215
6,416,353 B1 * 7/2002 Hwang et al. ..... 439/484
6,416,354 B1 * 7/2002 Lee ..... 439/484
6,500,023 B1 * 12/2002 Duong et al. ..... 439/484

* cited by examiner

*Primary Examiner*—Ross Gushi
(74) *Attorney, Agent, or Firm*—Wei Te Chung

(57) ABSTRACT

An electrical connector assembly (100) includes a first insulative housing (20), a second insulative housing (10), a plurality of terminals (26) and a pull tab (30). The first insulative housing comprises a pair of first ends, the first ends includes a first retention structure (28) and a pair of positioning holes (224), respectively. The second insulative housing comprises a pair of second ends, the second ends comprises a second retention structure (12) engagable with the first retention structure at different angle and a pair of holes (122), respectively, the hole and the positioning align with each other. The pull tab comprises a main body (32) and a pair of positioning parts (34) extending from the main body (32), the positioning part extends through the positioning holes and the holes.

11 Claims, 8 Drawing Sheets

ELECTRICAL CONNECTOR ASSEMBLY

BACKGROUND OF THE INVENTION

1. Field of the Invention

The present invention generally relates to an electrical connector assembly, and particular to a cable end connector assembly.

2. Description of Prior Arts

In U.S. Pat. No. 6,398,597, a cable end connector assembly for contacting with a complementary electrical connector includes an insulative housing, a plurality of terminals received in the housing, a shield and a cable having a plurality of conductors electrically connecting to the terminals respectively. The mating direction of the cable end connector assembly with the complementary electrical connector is parallel to the main board, and is parallel to a direction along which the cable extends.

In some special application, the mating direction of the cable connector end assembly needs to be perpendicular to the main board and/or the cable.

The cable connector end assembly having different mating directions needs to be separately manufactured using different molds, thereby increasing the cost of the production and wasting a lot of time.

Hence, it is desirable to have an improved connector to overcome the above-mentioned disadvantages of the prior art.

BRIEF SUMMARY OF THE INVENTION

Accordingly, it is an object of the present invention to provide a electrical connector assembly which has different mating directions respect to a cable thereof.

In order to achieve the above-mentioned objects, an electrical connector assembly comprises a first insulative housing, a second insulative housing, a plurality of terminals and a pull tab. The first insulative housing comprises a pair of first ends, the first ends comprise a first retention structure and a pair of positioning holes, respectively. The second insulative housing comprises a pair of second ends, the second ends comprises a second retention structure engagable with the first retention structure at different angle and a pair of holes, respectively, the hole and the positioning align with each other. The pull tab comprises a main body and a pair of positioning parts extending from the main body, the positioning part extends through the positioning holes and the holes.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
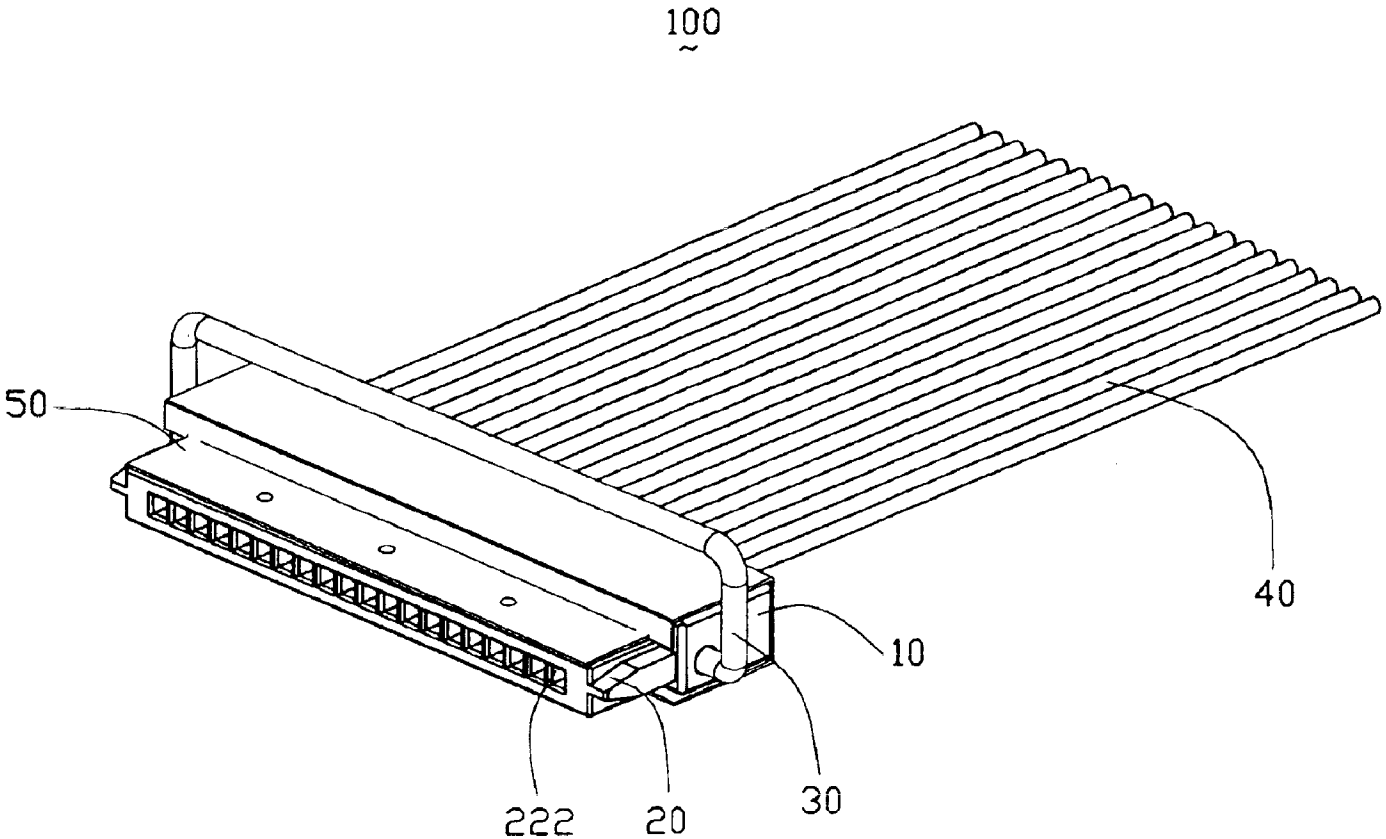
FIG. 1 is a perspective view of a cable end connector assembly assembled in accordance with a first embodiment of the present invention.

Reference will now be made to the drawing figures to describe the present invention in detail.

With reference to FIGS. 1–4, an electrical connector assembly 100 comprises a first insulative housing 20, a second insulative housing 10 assembled to the first insulative housing 20, a plurality of terminals 26 received in the first insulative housing 20, a cable 40, a pull tab 30 and a shell 50.

Figure 5:
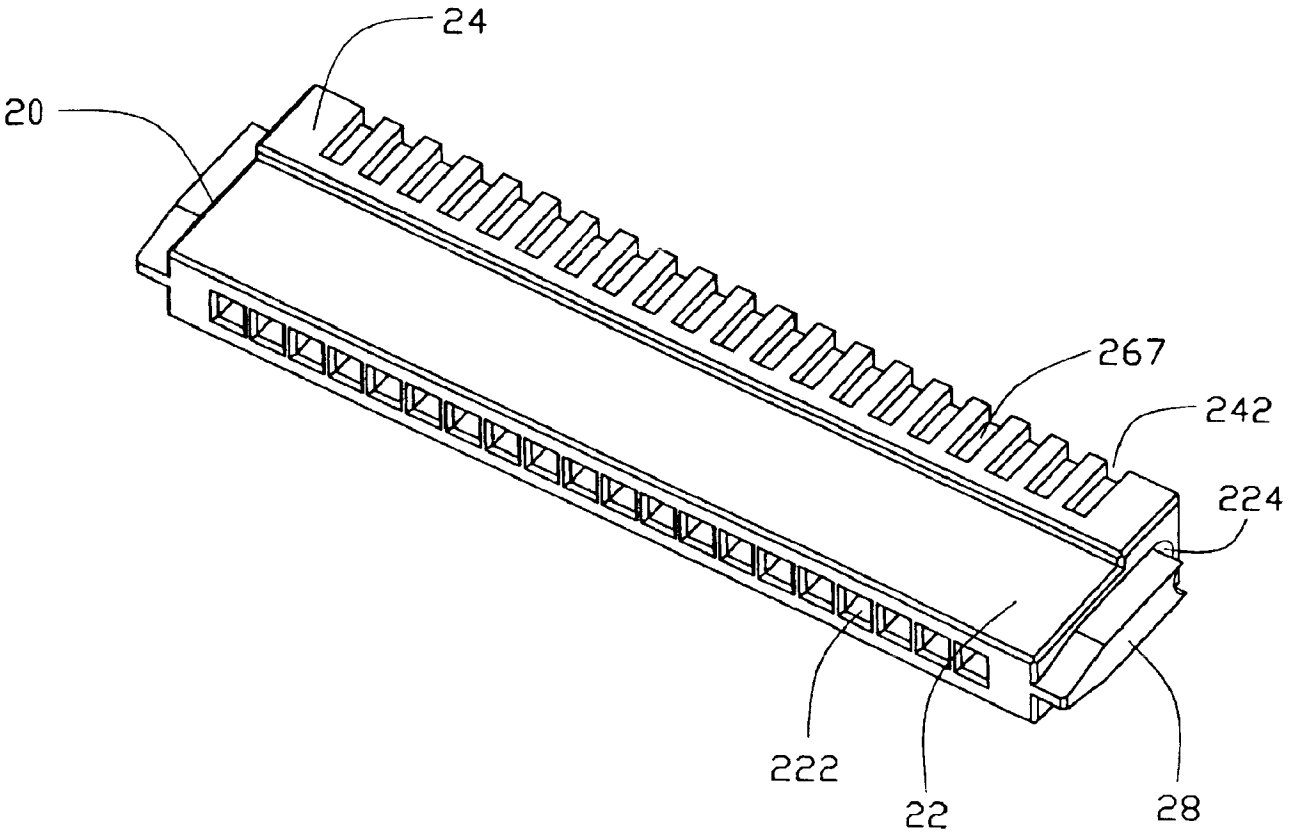
FIG. 5 is a perspective view of a first insulative housing of the cable end connector assembly.

With reference to FIG. 5, in this embodiment of the present invention, the first retention the first insulative housing 20 comprises a base part 24, a mating part 22 extending from the base part 24 for mating with the complementary connector (not shown) mounted on the printed circuit board, a plurality of depression recesses 242 and a plurality of slots 222 extending through the mating part 22 and communicated with the corresponding depression recesses 242. The depression recesses 242 are formed at the rear end of the base part 24. The first insulative housing 20 comprises a pair of first retention structures. In this embodiment, the first retention structures are a pair of ribs 28 extending forwardly from opposite ends thereof, The opposite sides of the mating part 22 define a pair of positioning holes 224. The positioning hole 224 is adjacent to the rib 28.

Figure 6:
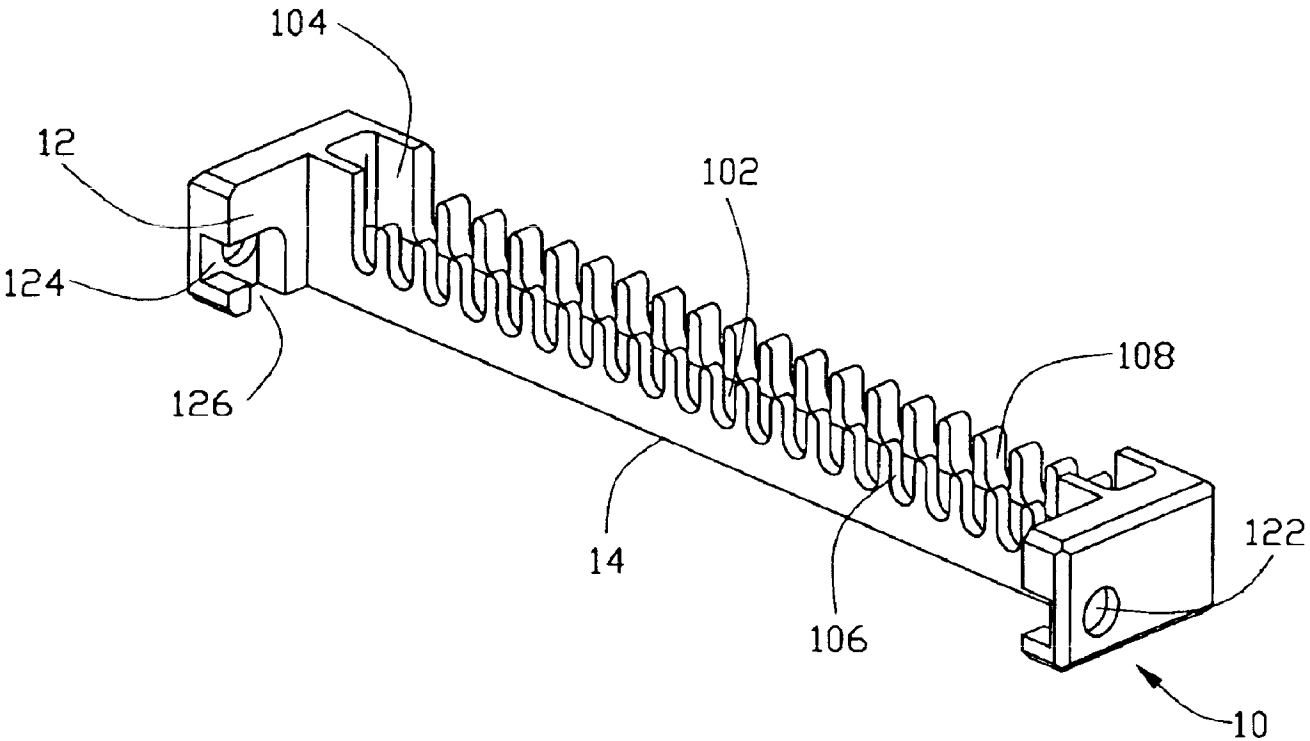
FIG. 6 is a perspective view of a second insulative housing of the cable connector assembly.

With reference to FIG. 6, the second insulative housing 10 comprises an elongated base 102, a pair of receiving arms 104 extending upwardly from opposite sides of the base 102, a plurality of passageways 106 alternatively defined at the rear end thereof and a plurality of receiving cavities 108 in communication with the passageways 106. A pair of second retention structures extend forwardly from opposite ends of the base. In this embodiment, the second structures are a pair of arms defined a receiving space 14 therebetween. Each arm 12 defines a hole 122 extending therethrough corresponding to the positioning hole and a pair of first cavity 124 and a pair of second cavity 126 in a inner face thereof, the first cavity 124 and the second cavity communicate with each other and communicate with the hole 122, respectively. When the base part 24 of the first insualtive housing is received in the receiving space 14, the positioning hole 224 and the hole 122 align with each other.

In another embodiments of present invention, the first retention structures are the arms, and the second retention structures are the ribs.

Figure 2:
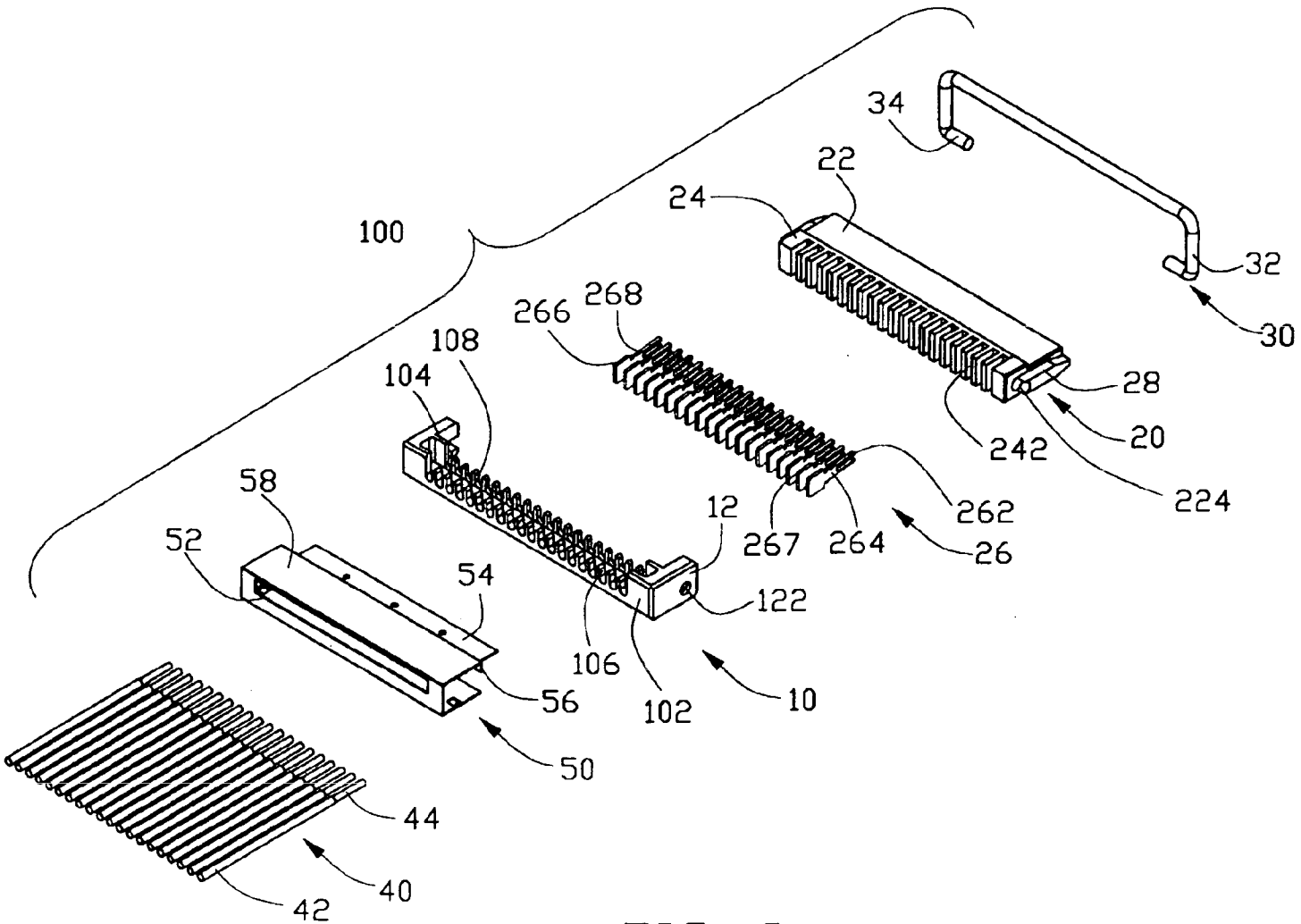
FIG. 2 is an exploded view of the cable end connector assembly shown in FIG. 1.
Figure 3:
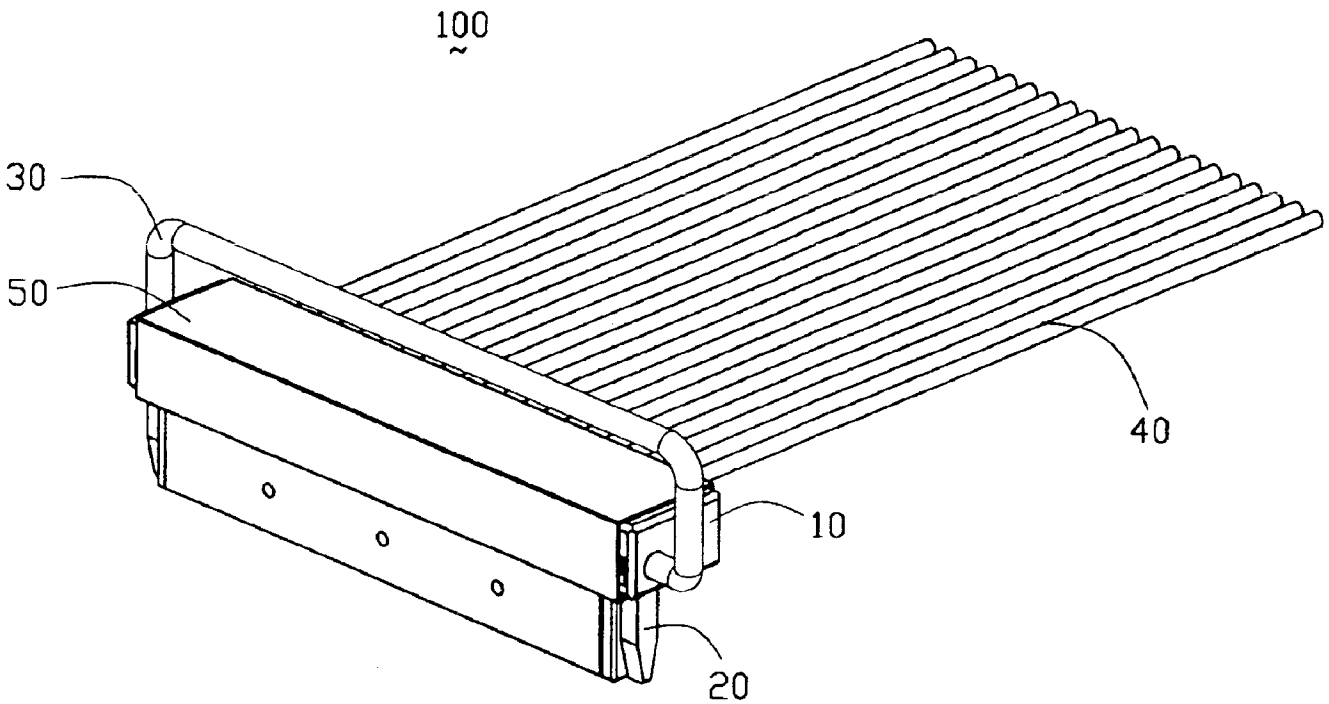
FIG. 3 is a perspective view of a cable end connector assembly assembled in accordance with a second embodiment of the present invention.
Figure 4:
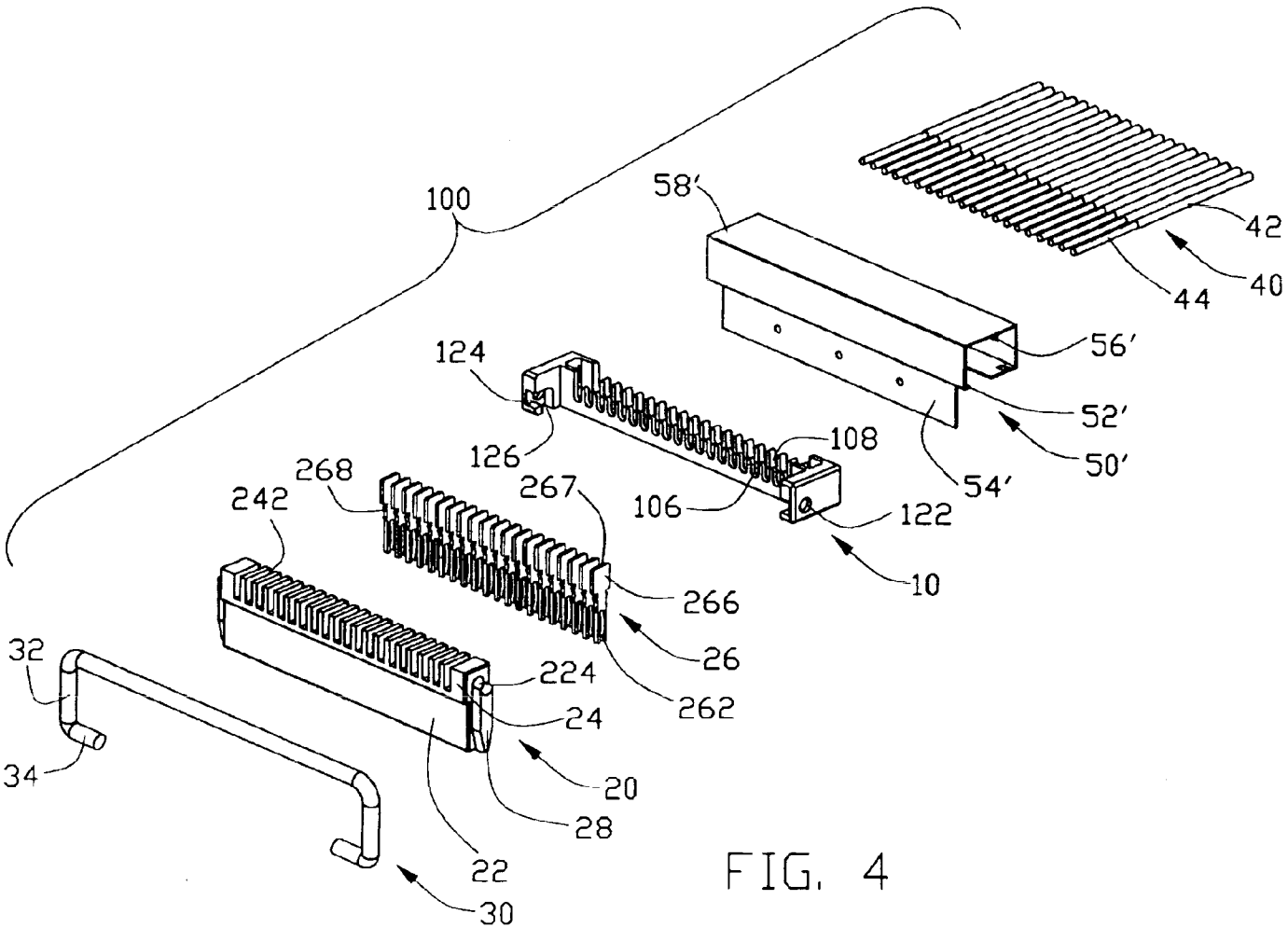
FIG. 4 is an exploded view of the cable end connector assembly shown in FIG. 3.

With reference to FIG. 2 and FIG. 4, each terminal 26 comprises a retaining portion 264, an engaging portion 262 extending from the retaining portion 264 and a contacting portion 266 extending from the retaining portion 264 away from the engaging portion 264. The engaging portions 262 and the retaining portions 264 are received in the slots 222, and the contacting portions 266 extend into the depression recesses 242. The retaining portion 264 is formed with a plurality of barbs 268 for engaging with the inner face of the slots 222.

The pull tab 30 comprises a generally U-shaped main body 32 and a pair of positioning parts 34 extending horizontally from free ends of the main body 32. The positioning parts 34 extend into the holes 122 and the positioning holes 224.

The cable 40 comprises a plurality of wires 42. Each wire 42 comprises a conductor 44 for electrically connecting to the contacting portion 266 of the terminal 26 and an insulative layer (not labeled) enclosing the conductor 44. When the cable 40 is assembled to the first insulative housing 10, each wire 42 extends into a corresponding passageway 106 and receiving cavity 108, and the conductor is soldered to the corresponding terminal 26.

Referring to FIG. 2, the shell 50 in accordance with the first embodiment of the present invention comprises a base portion 58 enclosing the second insulative housing 10, a rectangular slit 52 adapted in the rear wall (not labeled) of the base portion 58, a stopping plate 54 extending forwardly from the front end of the base portion 58 and a shielding plate 56 extending vertically from the stopping plate 54. The cable 40 extends beyond the rear end of the shell. The shielding plate 56 is attached to the outer face of the mating part 22.

Referring to FIG. 4, a shell 50' in accordance with a second embodiment of the preset invention comprises a base portion 58' enclosing the second insulative housing 10, a rectangular slit 52' adapted in the rear wall (not labeled) of the base portion 58', a stopping plate 54' extending downwardly from the front end of the base portion 58' and a shielding plate 56' extending vertically from the stopping plate 54'. The cable 40 extends beyond the bottom end of the shell. The shielding plate 56' is attached to the outer face of the mating part 22.

Figure 7:
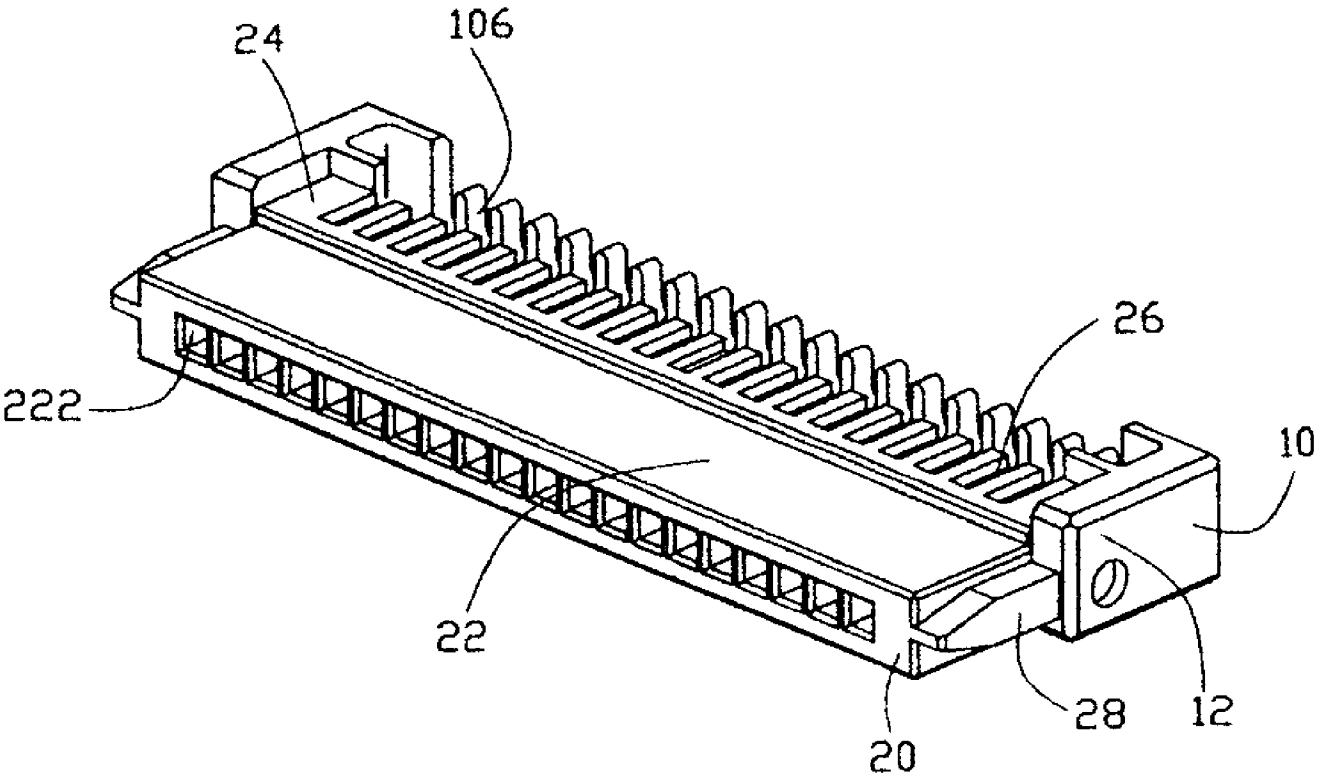
FIG. 7 is a perspective view of the first insulative housing and the second insulative housing assembled in accordance with the first embodiment.
Figure 8:
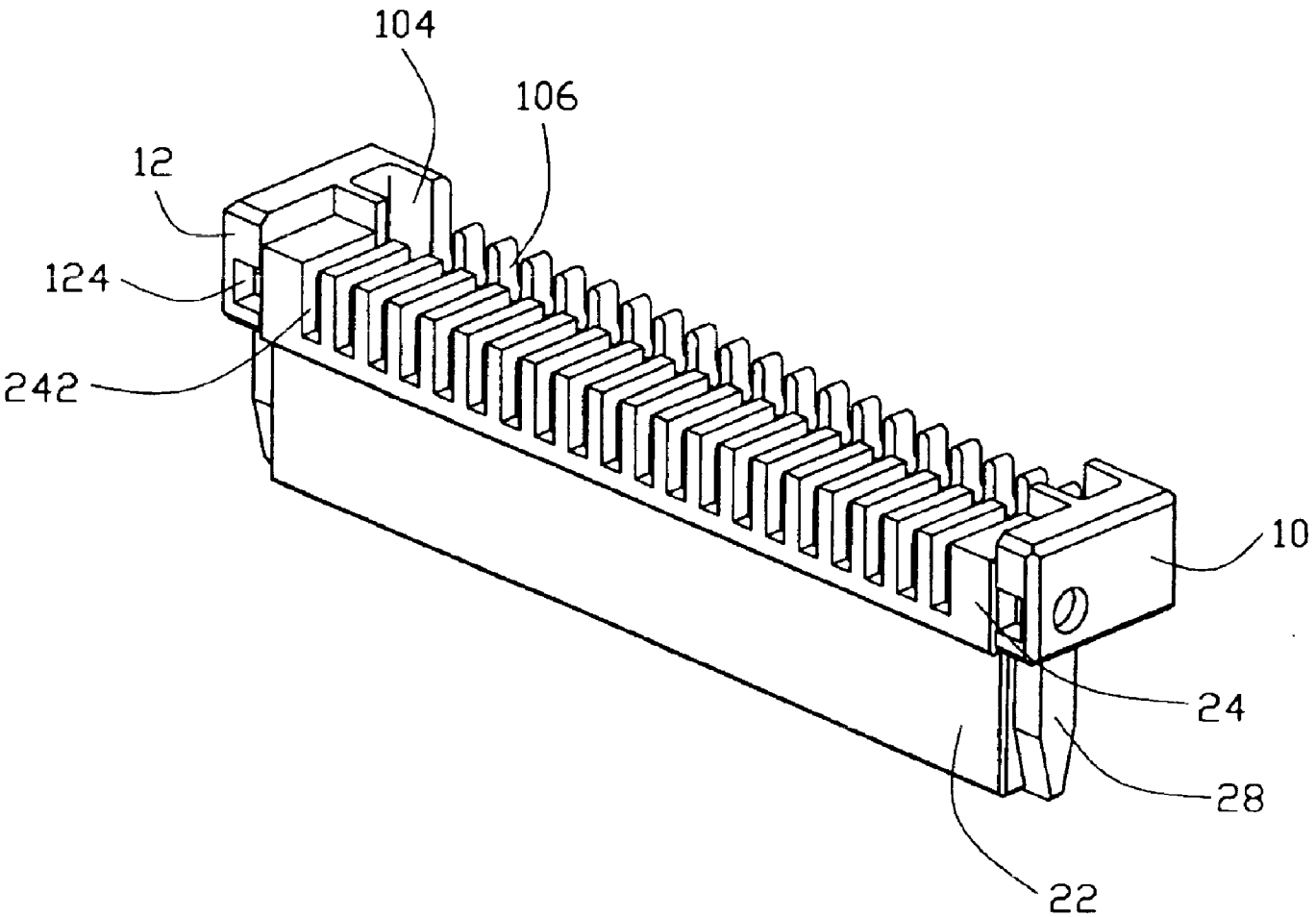
FIG. 8 is a perspective view of the first insulative housing and the second insulative housing assembled in accordance with the second embodiment.

Together with reference to FIGS. 7–8, the first and second insulative housing 20, 10 may be assembled together in two different ways. In accordance with the first embodiment of the present invention, the rib 28 of the first insulative housing 20 engages with the first cavity 124, the second insulative housing 10 extends in a direction parallel to a direction along which the first insulative housing 10 extends. In accordance with the second embodiment, the rib 28 of the first insulative housing 20 engages with the second cavity 126, the second insulative housing extends in a direction perpendicular to a direction along which the first insulative housing extends.

The first insulative housing 10 and second insulative housing 20 of the cable end connector assembly 100 of the present invention having different processes of assembly, so the cable end connector assembly 100 do not need to design a new mold for changing the mating direction, which decreases the manufacturing cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector assembly comprising:

a first insulative housing comprising a pair of first ends, each first end comprising a first retention structure and a positioning hole;

a plurality of terminals received in the first insulative housing;

a second insulative housing comprising a pair of second ends, each second end comprising a second retention-structure engagable with the first retention structure at different angles and a hole aligned with the positioning hole; and a pull tab comprising a main body and a pair of positioning parts extending from the main body, the positioning part extending through the positioning hole of the first insulative housing and the hole of the second insulative housing.

2. The electrical connector assembly as described in claim 1, wherein the first retention structure is a rib, and the second retention comprises a first and a second cavities.

3. The electrical connector assembly as described in claim 2, wherein the first cavity is perpendicular to the second cavity.

4. The electrical connector assembly as described in claim 1, wherein the first insulative housing comprises a base part, a mating part extending from the base part, a plurality of recesses and a plurality of slots extending through the mating part and communicating with the depression recesses.

5. The electrical connector assembly as described in claim 4, wherein each terminal comprise a retaining portion, an engaging portion extending from the retaining portion and a contacting portion extending from the engaging portion, the engaging portion and the retaining portion being received in the slot, the contacting portion being received in the recesses.

6. The electrical connector assembly as described in claim 1, the second insulative housing comprises a base, a pair of receiving arms extending from the base, a plurality of passageways defined at the rear end thereof and a plurality of cavities communicating with the passageways.

7. The electrical connector assembly as described in claim 6, further comprising a plurality of wires each having a conductor and an insulative layer, each wire extending into the passageway and the receiving cavity of the second insulative housing.

8. An electrical connector assembly comprising:

a first insulative elongated housing defining a pair of first retention structures at two opposite ends thereof, respectively;

a plurality of juxtaposed contacts disposed in said first housing;

a second insulative elongated housing defining a pair of second retention structures at two opposite ends thereof, respectively, said pair of second retention structures engaged with the pair of corresponding first retention structures, respectively;

a plurality of juxtaposed notches formed in said second housing; and a plurality of wires including outer jackets received in the corresponding notches with inner conductors mechanically and electrically connected to the corresponding contacts, respectively, wherein one pair of said pair of first retention structures and said pair of second retention structures is provided with two different oriented mechanisms perpendicular to each other so as to allow the pair of the first retention structures and the pair of the second retention structures to be assembled to each other mutually exclusively in two different respective orientations.

9. The assembly as described in claim 8, wherein said first housing includes a plurality of depression recesses receiving the corresponding contacts and inner conductors, respectively.

10. The assembly as described in claim 8, wherein a pull tab is attached to said second housing.

11. The assembly as described in claim 8, wherein two different metallic shields mutually enclose said assembled first and second housings in said two different respective orientations.

* * * * *